US007255055B2

(12) United States Patent
Whybourne

(10) Patent No.: US 7,255,055 B2
(45) Date of Patent: Aug. 14, 2007

(54) FLOATING DOCKING SYSTEM

(76) Inventor: Duane Whybourne, 5504 Regional Road 69, St. Anns, Ontario (CA) L0R 1Y0

( * ) Notice: Subject to any disclaimer, the term of this patent is extended or adjusted under 35 U.S.C. 154(b) by 0 days.

(21) Appl. No.: 11/125,909

(22) Filed: May 10, 2005

(65) Prior Publication Data

US 2006/0254492 A1 Nov. 16, 2006

(30) Foreign Application Priority Data

Aug. 4, 2005 (CA) ..... 0256275

(51) Int. Cl.
*B63B 35/44* (2006.01)

(52) U.S. Cl. ..... 114/263

(58) Field of Classification Search ..... 114/263
See application file for complete search history.

(56) References Cited

U.S. PATENT DOCUMENTS 4,060,048 A 11/1977 Breheret et al.
4,474,504 A * 10/1984 Whitman et al. ..... 405/16
5,281,055 A 1/1994 Neitzke et al.
6,006,687 A * 12/1999 Hillman et al. ..... 114/46
6,073,572 A 6/2000 Gruhn et al.
6,138,600 A * 10/2000 Berquist ..... 114/267
6,179,525 B1 * 1/2001 Gruhn et al. ..... 405/219

* cited by examiner

*Primary Examiner*—Stephen Avila
(74) *Attorney, Agent, or Firm*—Greer, Burns & Crain, Ltd.

(57) ABSTRACT

A floating dock comprises a plurality of floats, and a plurality of connectors for joining the floats together, each float having a top surface, a bottom surface, two opposed side surfaces and two opposed end surfaces. Each of the side and end surfaces have at least one tapered connecting slot formed therein, extending from the bottom surface of the float to the top surface of the float. The connectors have a shape complementary to the connecting slots, whereby a single connector will span between aligned connecting slots on an adjacent pair of floats.

11 Claims, 4 Drawing Sheets

FLOATING DOCKING SYSTEM

The present invention relates to the field of modular floating structures such as floating docks and rafts.

BACKGROUND

There exists a need, and a substantial market for a durable, simple to assemble, maintain and repair floating dock system. Floating dock systems are key practical alternatives to permanent docks in geographical areas that encounter ice in the wintertime, especially if the ice breaks up and moves in the spring. Moving ice can destroy a dock that is immovably secured to a lake or river bottom.

There have been many forms of floating dock proposed. In a simple form, a floating dock can be built using drums or pontoons fastened together with a dock laid on top. Of course, this sort of custom built dock will only be as good as the person building it is capable of making it. Often, this type of dock is awkward and dangerous to use.

An example of a prefabricated dock that has been marketed is shown in CA2308617 (Gruhn et al). This dock consists of a number of hollow-bottom floats with textured upper surfaces. The floats can be fastened together using custom fabricated fastening elements that fit into custom shaped profiled slots on the sides of the floats. The slots are profiled to provide a fit with the fasteners. While this dock assembly system has some attractive features, there are drawbacks associated with it, particularly the profiled connectors that are used to connect floats together.

These connectors are effective in securing together adjacent floats, but tend to permit more flex than is desirable between adjacent floats. Moreover, the pre-textured upper surface of the floats will dictate that they should all be assembled in a parallel arrangement, which may limit available assembly options.

SUMMARY

The present invention overcomes perceived drawbacks associated with floating dock systems by providing floats that are connected together by connectors that use a wedging action to secure floats together more securely than has been possible using previous systems. Moreover, the present invention uses floats to construct a perimeter skeleton of a floating structure, and then uses traditional docking materials such as wood or artificial wood to construct a dock surface. This permits a larger dock surface to be constructed using a smaller number of floats than has previously been possible. It also permits a consumer to maintain and repair a dock surface by replacing a low cost item, namely a wooden plank, where with other systems a high cost item, namely a float, would need replacement.

In a broad aspect, then, the present invention relates to a floating dock comprising a plurality of floats, and a plurality of connectors for joining said floats together, each said float having a top surface, a bottom surface, two opposed side surfaces and two opposed end surfaces, each of said side and end surfaces having at least one tapered connecting slot formed therein, extending from the bottom surface of the float to the top surface of the float, said connectors having a shape complementary to said connecting slots, whereby a single connector will span between aligned connecting slots on an adjacent pair of floats.

According to a preferred form of the present invention, the connecting slots are dovetail shaped.

Moreover, the dovetail-shaped connecting slots will, preferably, taper from one end to the other. Most preferably, the dovetail-shaped connecting slots taper from bottom to top.

Recessed portions may be provided on the top surface of said floats, around the upper ends of said connecting slots.

Header blocks are therefore preferably provided, and are dimensioned to fit in said recesses, and are securable to the upper ends of said connectors, thereby to firmly wedge said connectors in said slots.

The recesses, and the header blocks, may be rectangular.

In a preferred embodiment, the connectors are double dovetail shaped, and tapered from bottom to top.

The floats and the connectors may be made from polyethylene.

The header blocks may be connected to the connectors by corrosion-resistant screws or bolts.

A wooden dock surface will preferably be secured to a perimeter assembly of said floats.

BRIEF DESCRIPTION OF THE DRAWINGS

In drawings that illustrate the present invention by way of example.

DETAILED DESCRIPTION

Figure 1:
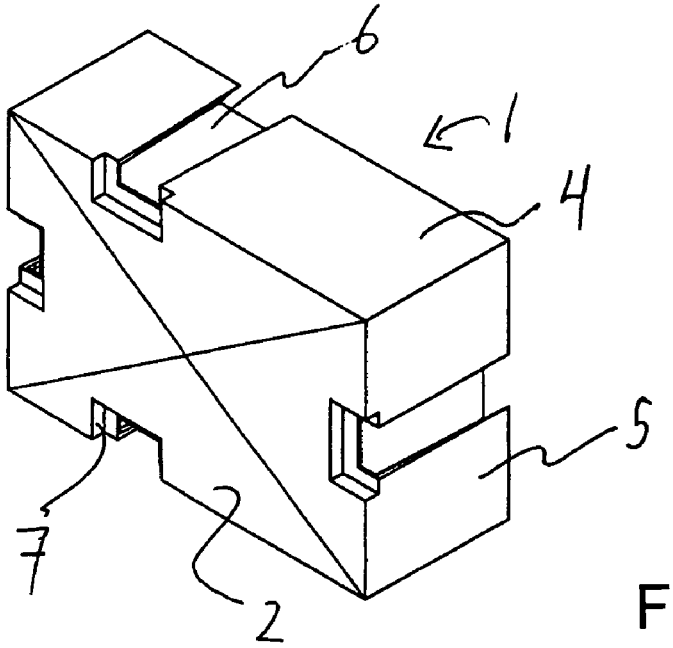
FIG. 1 is a perspective view of a float for a floating dock according to the present invention.
Figure 2:
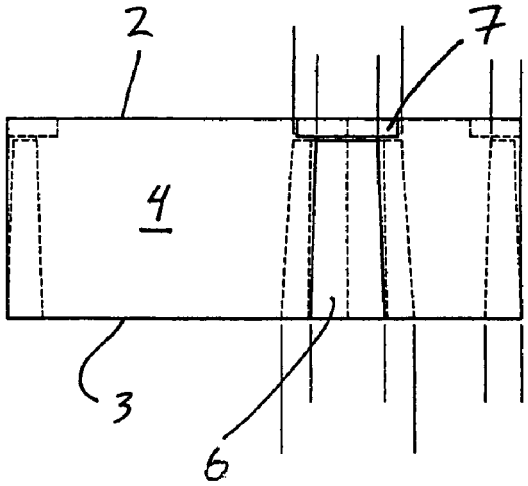
FIG. 2 is a side view, partly in phantom, of the float shown in FIG. 1.

Referring now to FIGS. 1 and 2, the basic unit of the present invention is a rectangular float 1 with a top surface 2, a bottom surface 3, side surfaces 4 and end surfaces 5. At least one connecting slot 6 is formed in each of the side 4 and end 5 surfaces. If desired, more than one slot may be formed in each such side and end surface.

Each connecting slot extends from the bottom 3 to the top 4 surfaces of the float, and is generally dove-tail shaped. That is, the slots widen inwardly of the outer surfaces of the floats. Each slot is tapered from bottom to top, as can be seen by the dotted lines in FIG. 2, which illustrate the inner dimension of the slots. A generally rectangular recess 7 is formed in the top surface 2 of the float at the upper end of each connecting slot 6.

Figure 3:
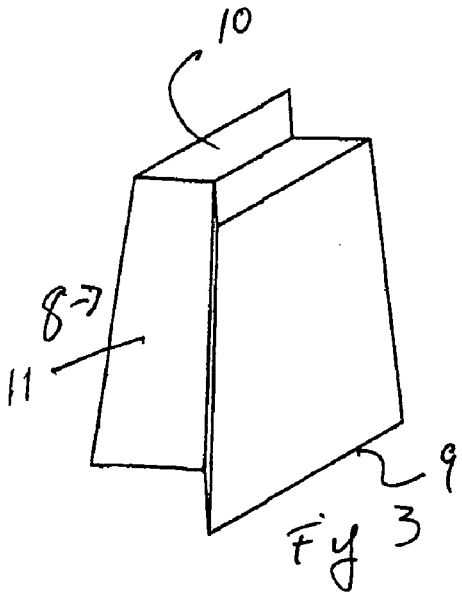
FIG. 3 is a perspective view of a connector for connecting together two of the floats shown in FIG. 1.
Figure 4:
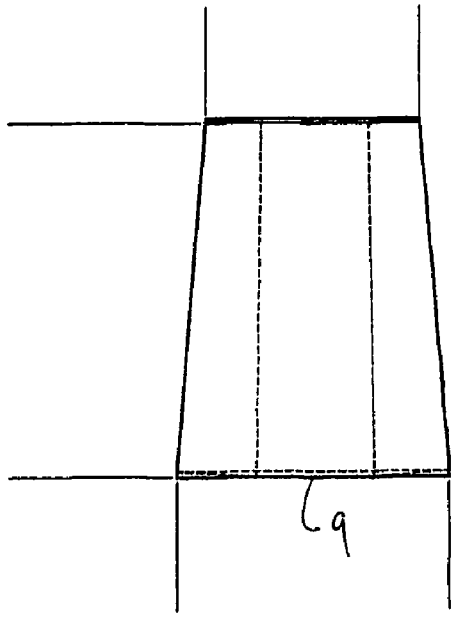
FIG. 4 is a front view, partly in phantom, of the connector of FIG. 3.

Referring now to FIGS. 3 and 4, a connector 8 for connecting together two floats is shown. Each connector is a bottom-to-top tapered double dove-tail with an overall bow-tie shape when viewed from above. The connector has a lower surface 9 and an upper surface 10 that is smaller than the lower surface 9. Inwardly angulated side surfaces 111 extend between the lower 9 and upper 10 surfaces.

The manner of attachment of two floats is as follows: the floats are set out, with their lower surfaces 3 facing up, and two slots 6 (one on each float) aligned with each other. A connector 8 is then slipped into the slots, and hammered firmly into place with a rubber mallet, firmly connecting the two floats together through the wedging action of the tapered connectors being driven into the tapered slots.

The pair of floats (or more floats, as needed) are then flipped over, so that the upper surfaces 2 are exposed. Header blocks 11 (see FIG. 5) are then placed in the rectangular recesses, with one header block 11 in each recess, and screws 12 (see FIG. 5) are driven through the header blocks 11, into the top surfaces 10 of the connectors 8. This prevents the connectors form slipping down out of the slots 6. Header blocks spanning two recesses (not illustrated) may be used to maintain the upper surfaces of adjacent blocks in a co-planar relationship.

Figure 5:
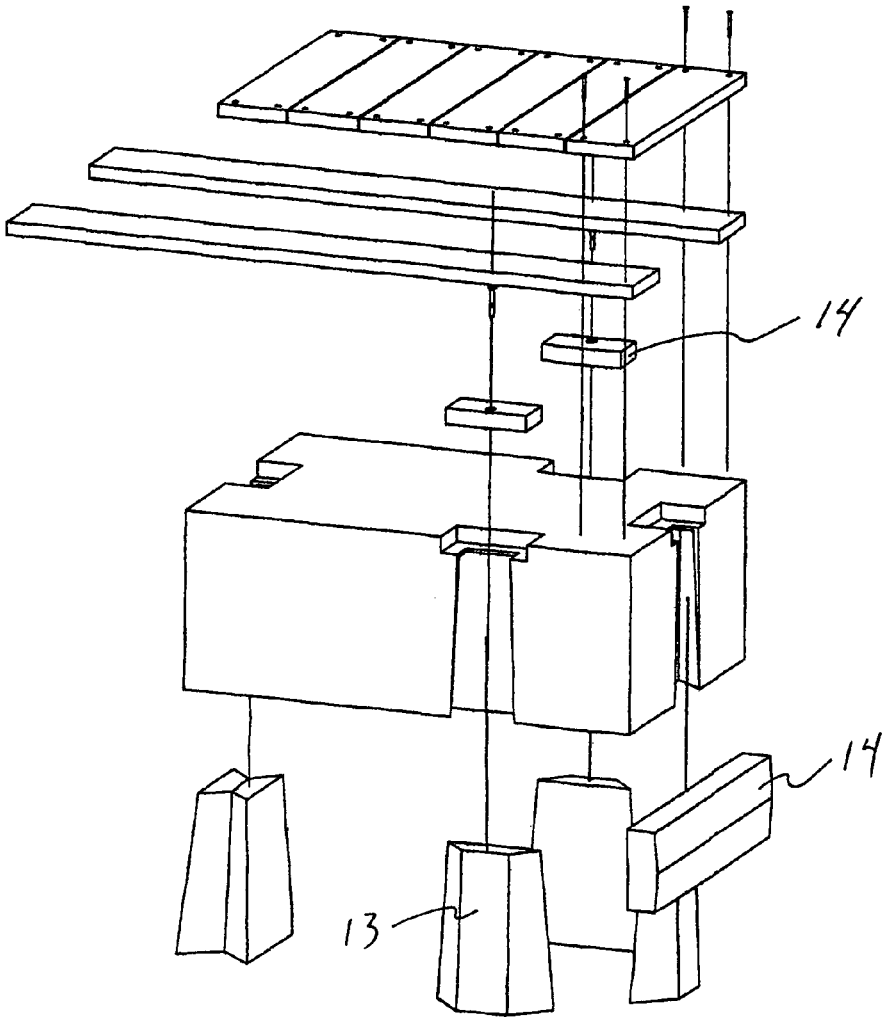
FIG. 5 is an exploded view of a portion of a dock constructed using the floats and connectors of the present invention.

As can be seen from FIG. 5, both the connectors 8, and header blocks 11 are available in half-width versions 13, 14, for filling slots 6 around the outer perimeter of the assembled structure.

Moreover, the half-width connector 13 may have a bumper 14 integrally connected thereto, to provide a series of bumpers around a dock. The bumper may be molded with the half-width connector, or it may be secured thereto by adhesive, heat welding, fasteners, or any other suitable means.

Figure 6:
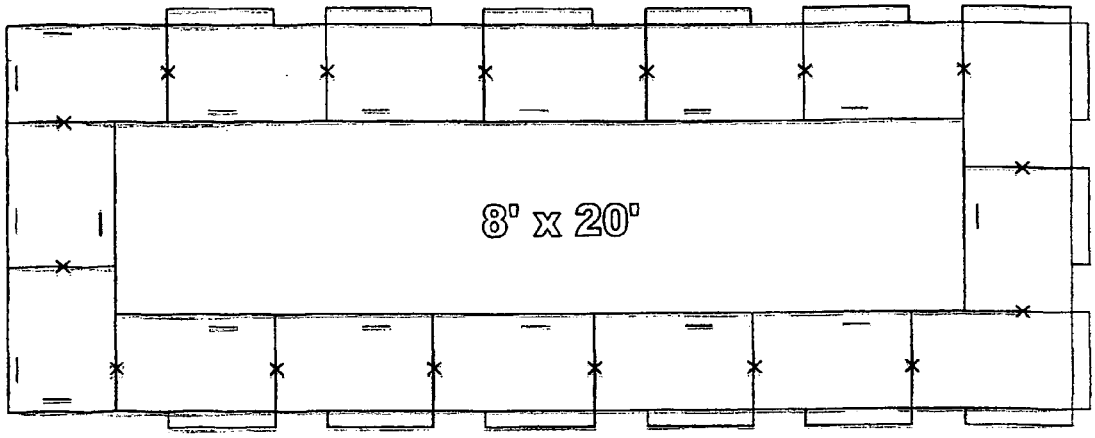
FIG. 6 is a schematic view of a lay-out of a number of the floats of the present invention, for use in constructing a large dock.

A plurality of floats are connected together using the connectors of the present invention, into a configuration such as that shown in FIG. 6. It will be appreciated that any appropriate and desired lay-out may be used. Wooden headers are then laid on the floats and secured thereto with screws. Wood or artificial docking is then laid on the headers, and screwed into place.

The floats are made from a high impact, UV stable material, such as polyethylene, about 0.5 to 1.0 cm thick. The connector ties are also made from polyethylene, and may be solid or hollow. They are preferably solid. The head blocks and bumpers are also preferably polyethylene. It will be understood that any other suitable material may be utilized for any part, as will be obvious to one skilled in the art.

The invention claimed is:

1. A floating dock comprising a plurality of floats, and a plurality of connectors for joining said floats together, each said float having a top surface, a bottom surface, two opposed side surfaces and two opposed end surfaces, each of said side and end surfaces having at least one tapered, dovetail-shaped connecting slot formed therein, extending from the bottom surface of the float to the top surface of the float, said connectors having a shape complementary to said connecting slots, whereby a single connector will span between aligned connecting slots on an adjacent pair of floats.

2. The floating dock of claim 1, wherein said dovetail-shaped connecting slots taper from one end to the other.

3. The floating dock of claim 2, wherein said dovetail-shaped connecting slots taper from bottom to top.

4. The floating dock of claim 3, wherein recessed portions are provided on the top surface of said floats, around the upper ends of said connecting slots.

5. The floating dock of claim 4, further comprising header blocks dimensioned to fit in said recesses, and securable to the upper ends of said connectors, thereby to firmly wedge said connectors in said slots.

6. The floating dock of claim 5, wherein said recesses, and said header blocks, are rectangular.

7. The floating dock of claim 5, wherein said connectors are double dovetail shaped, and tapered from bottom to top.

8. The floating dock of claim 7, wherein said floats and said connectors are made from polyethylene.

9. The floating dock of claim 8, wherein said header blocks are connected to said connectors by corrosion-resistant screws or bolts.

10. The floating dock of claim 9, further comprising a wooden dock surface secured to a perimeter assembly of said floats.

11. A floating dock comprising a plurality of floats, and a plurality of connectors for joining said floats together, each said float having a top surface, a bottom surface, two opposed side surfaces and two opposed end surfaces, each of said side and end surfaces having at least one tapered, dovetail-shaped connecting slot formed therein, extending from the bottom surface of the float to the top surface of the float and tapering from the bottom surface to the top surface, said connectors having a shape complementary to said connecting slots, whereby a single connector will span between aligned connecting slots on an adjacent pair of floats, wherein recessed portions are provided on the top surface of said floats, around the upper ends of said connecting slots.

* * * * *